United States Patent [19]

Efrom

[11] Patent Number: 4,592,473

[45] Date of Patent: Jun. 3, 1986

[54] CLOTHES DRYING RACK AND ACCOMPANYING RECEPTACLE

[76] Inventor: Harriet Efrom, 4533 Adams Ave., Miami Beach, Fla. 33140

[21] Appl. No.: 727,160

[22] Filed: Apr. 25, 1985

Related U.S. Application Data

[63] Continuation-in-part of Ser. No. 535,915, Sep. 26, 1983, abandoned.

[51] Int. Cl.[4] ..... A47B 47/00

[52] U.S. Cl. ..... 211/205; 211/189

[58] Field of Search ..... 211/205, 189, 196; 248/213.2; 108/115

[56] References Cited

U.S. PATENT DOCUMENTS

| | | | |
|---|---|---|---|
| 66,520 | 7/1867 | Redding | 211/196 X |
| 420,838 | 2/1890 | Stauffer | 211/196 X |
| 896,990 | 8/1908 | Hill | 211/196 X |
| 1,326,059 | 12/1919 | Humphrey | 211/196 X |
| 2,277,332 | 3/1932 | Lamb | 211/196 |
| 2,447,924 | 8/1948 | Vitale | 211/205 |
| 2,542,137 | 2/1951 | Hanson | 211/196 X |
| 2,604,214 | 7/1952 | Fussell | 211/196 X |
| 3,023,912 | 3/1962 | Sebastian | 211/196 |
| 3,131,112 | 4/1964 | Abramson | 211/205 X |
| 3,589,311 | 6/1971 | Medlen | 108/115 X |
| 3,661,270 | 5/1972 | Lucci et al. | 211/205 X |
| 4,323,163 | 4/1982 | Johns | 211/189 |

*Primary Examiner*—Robert W. Gibson, Jr.
*Assistant Examiner*—Blair M. Johnson
*Attorney, Agent, or Firm*—John Cyril Malloy

[57] ABSTRACT

A clothes rack structure removably secured to and extending above a water or drip catching receptacle wherein a plurality of arms are connected to an upstanding stanchion and are positioned in overlying relation to the interior of the receptacle. Clothes or like articles are mounted on the individual arms and are suspended therefrom such that when drying, water dripping therefrom will be collected in the underlying receptacle. Certain components of the clothes drying assembly are detachable from one another and dimensioned to be disposed and retained in substantially surrounded relation within the interior of the receptacle so as to require a minimal of room for storage when not in use.

12 Claims, 11 Drawing Figures

CLOTHES DRYING RACK AND ACCOMPANYING RECEPTACLE

BACKGROUND OF THE INVENTION

This is a continuation-in-part application of application Ser. No. 535,915 filed Sept. 26, 1983, now abandoned.

1. Field of the Invention

The present invention relates to a drying rack for clothes or like articles including an upstanding stanchion removably secured to an underlying receptacle positioned for collection of water dripping from suspended wet clothes or articles supported on arms connected to the stanchion.

2. Description of the Prior Art

Drying structures including drying racks which are structured to support garments, clothes or like articles thereon have been known and in use for many years. Typically the structure of such prior art devices includes an upstanding rack having a plurality of arms extending outwardly from an upper end thereof wherein the arms are spaced apart from one another and structured to have clothes, garments or the like suspended therefrom.

A review of the prior art patents relating to these type of structures show that such type of structures are designed for use both inside and outside of a dwelling. In addition, these prior art devices are structured to be portable such that they may be set up and utilized only when needed and do not have to be constantly present and obvious during non-use.

U.S. Patents which are representative of the known, prior art devices include the U.S. Pat. Nos. to Stauffer, 420,838; Trager, 1,326,808; Dery, 2,249,348; Kurz, 3,307,712; and Lehrman, 3,572,260; Redding, 66,520; Hill, 896,990; Humphrey, 1,326,059; Lamb, 2,277,332; Hanson, 2,542,137; Vitale, 2,447,924; Fussell, 2,604,214; Sebastian, 3,023,912; Abramson, 3,131,112; and Lucci, 3,661,270.

Other structures existing in the prior art are represented by the above noted patents to Lehrman and Kurz. The structures disclosed therein are directed primarily to the drying of sweaters and like garments and include a wire mesh mounted under tension by a support frame or the like. These devices are usable indoors and may be positioned over a bathtub or like conventional receptacle to collect water dripping from the garments being dried. The above noted patent to Sebastian is representative of upstanding support assemblies which may be collapsible in part but which still may be considered too bulky or inconvenient when it is desired to "break down" the assembly for containment and storage.

The problem of collection is common to all of the structures represented by the above noted patents. Therefore, such prior art devices do not lend themselves to efficient indoor use since some type of auxiliary collection receptacle must be utilized to prevent water damage to floors and carpeting.

Therefore, there is a need for a clothes and garment drying assembly which is capable of effective use indoors without creating the mess normally associated with some prior art devices. Such an assembly should therefore include some type of cooperatively positioned receptacle and further the entire assembly preferably should be collapsible so as to allow storage in small areas.

SUMMARY OF THE INVENTION

The present invention relates to a drying assembly designed to support clothes, garments and like articles thereon in a manner which will facilitate drying and further which will collect the water drippings therefrom in a manner to prevent mess and allow use of the subject assembly at various locations indoors. More specifically, the drying assembly comprises a support means in the form of a stanchion. The stanchion is connected to a receptacle means at the lower end thereof and extends upwardly therefrom into supporting relation with a mounting means. The mounting means is disposed adjacent the upper end of the stanchion and comprises a plurality of arms extending substantially outwardly therefrom in overlying relation to the interior of the underlying receptacle means. By virtue of this relative arrangement, clothes may be supported on any of the outwardly extending arms and thereby exposed to the air so as to facilitate drying. Water dripping from the drying garments is collected in the underlying receptacle means for later disposal.

A preferred embodiment of the present invention, to be discussed in greater detail hereinafter, includes said support means including at least one but preferably a plurality of arms radially extending outwardly from a centrally disposed hub portion wherein the plurality of arms and hub portion are of an integral, one-piece construction. The arms and the hub portion have a substantially hollow interior which is accessible from an under portion of the mounting means. When in an operative position the mounting means is removably secured to a top free end of the stanchion through insertion of the extremity thereof into the hollow interior of the hub portion. When not in use or in a stored position, the mounting means is removably attached in overlying and retained engagement with the connecting means. The connecting means, in this embodiment, comprises a plurality of connecting arms extending radially outward from a central socket wherein the connecting arms are collectively dimensioned and configured to correspond to the plurality of arms of the mounting means. Accordingly, the hollowness of the mounting means allows its positioning in a nested fashion overlying the plurality of connecting arms such that the hub portion covers the centrally located socket of the connecting means.

Further retaining means include at least a first and second retaining portion secured to an inner surface of the receptacle means and being dimensioned and structured to removably engage and retain stanchion portions. Accordingly, the stanchion and the mounting means are both retained in at least partially surrounding and enclosed relation on the interior of the receptacle means for storage of the entire assembly in a minimal space.

BRIEF DESCRIPTION OF THE DRAWINGS

For a fuller understanding of the nature of the present invention, reference is had to the following detailed drawings, in which.

Similar reference characters refer to similar parts throughout the several views of the drawings.

DETAILED DESCRIPTION OF THE PREFERRED EMBODIMENT

Figure 1:
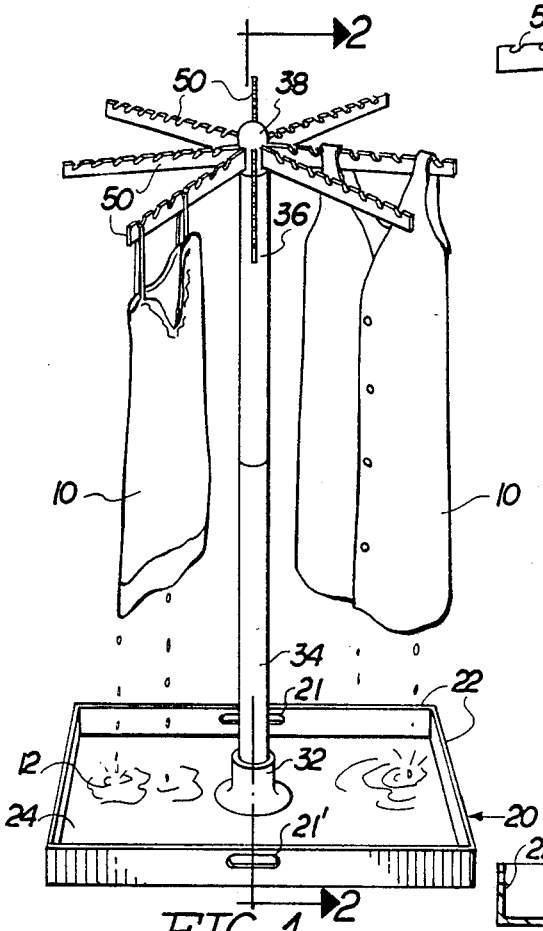
FIG. 1 is an isometric view of the drying assembly of the present invention with garments or clothes mounted thereon.
Figure 2:
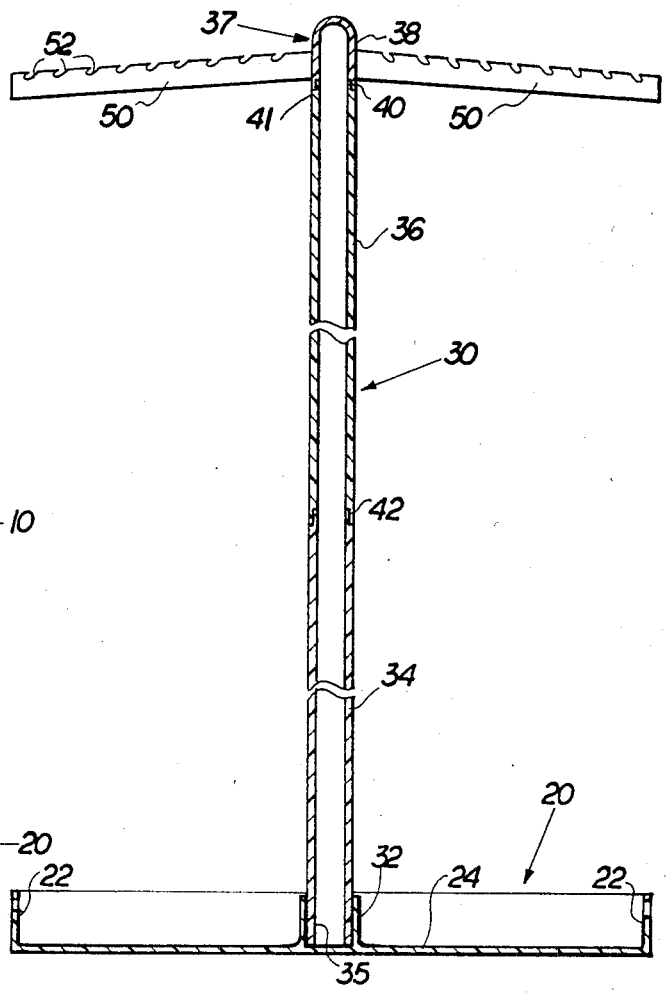
FIG. 2 is a sectionl view along line 2—2 of FIG. 1.

As best shown in FIGS. 1 and 2, the drying assembly of the present invention comprises a receptacle means generally indicated as 20 which includes peripheral walls 22 integrally connected to and extending upwardly from a floor 24 of the receptacle. These elements define the receptacle interior which has an overall dimension both longitudinal and transverse of predetermined length so as to catch water dripping from articles 10 such as clothes or the like being dried.

The assembly further comprises a stanchion 30 which, in the preferred embodiment, includes two stanchion portions 34 and 36 having their correspondingly positioned ends interconnected to one another as at 42. Futher, the stanchion portions are interconnected so as to be aligned in substantially coaxial relation to one another thereby defining the entire stanchion 30 extending upwardly from the floor 24 and the interior of the receptacle means 20.

A connecting means includes a connecting socket 32 integrally formed on the interior of the receptacle means 20 and being structured to be substantially hollow so as to surround, and thereby support the lower or free end 35 of stanchion portion 34. It should be further noted that the location of socket 32 is dependent upon the overall configuration and disposition of a plurality of arms 50 comprising an arm means which will be described in greater detail hereinafter. An important feature of the present invention is the disposition of the interior of the receptacle means 20 in underlying relation to the plurality of arms 50 such that water dripping from garments 10 will fall into and be collected as at 12 into the interior of the receptacle means 20.

As best shown in FIGS. 1 and 2, the stanchion 30 serves as a support means in that mounting means generally indicated as 37 is movably attached as at 40 to the upper or free end 41 of stanchion portion 36. The mounting means includes a central hub portion 38 interconnected to end 41 in telescoping relation as at connection 40. Arm means is connected to the hub portion 38 and comprises a plurality of arms 50 extending radially outward from hub portion 38 in substantially equally spaced relation to one another. As set forth above, the plurality of arms 50 and the interior of the receptacle means 22 are relatively disposed such that any garments or clothes 10 being suspended from the various arms must be positioned in overlying relation to the interior of the receptacle means 20. A collection of water 12 will thereby be maintained within receptacle means 20.

Figure 4:
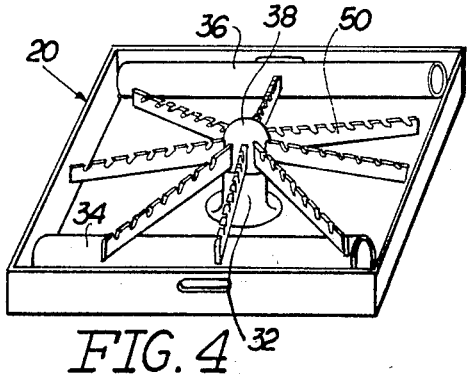
FIG. 4 is an isometric view of one embodiment of the assembly wherein the various components are separable from one another and stored in the interior of the receptacle means.

In the embodiment shown in FIG. 2, each of the arms 50 are integrally attached to the hub portion 38 and when the mounting means 37 is removed from the stanchion portion 36 it may be stored as a single piece (FIG. 4) in the interior of the receptacle means 20. More specifically, in this embodiment the hub portion may be connected to or telescopically fitted within the connecting socket 32 as also shown in FIG. 4.

Figure 3:
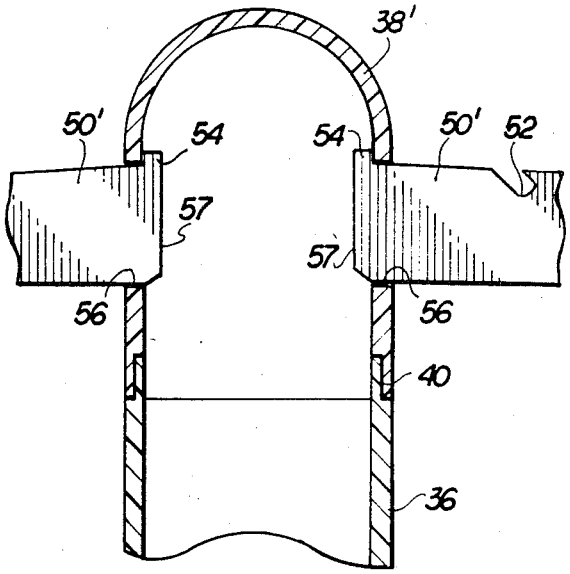
FIG. 3 is a detailed sectional view in partial cutaway of the mounting means wherein individual arms are removably secured to a hub portion thereof.
Figure 5:
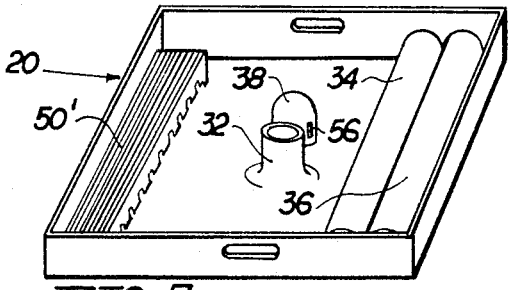
FIG. 5 is an isometric view of yet another embodiment of the present invention wherein the various components are separable from one another and the individual arm elements are detachable from the supporting hub portion as shown.

In the embodiment shown in FIG. 3, the hub portion 38 comprises a plurality of apertures 36 spaced about the outer periphery from one another. These apertures are structured and disposed to allow connection of the individual arms 50′ wherein upstanding finger 54 serves to secure the corresponding end 57 of each of the arms 50′ on the interior of the hub portion 38′. Breakdown or collapse of this embodiment occurs by removing each of the individual arms 50′ and storing such arms individually on the interior of the receptacle means 20. Further, with regard to the embodiments of FIGS. 4 and 5, the stanchion portions 34 and 36 are separable from one another and are also separable from the receptacle means 20 and the mounting means 37 respectively. Therefore, each of the stanchion portions 34 and 36 are mounted on the interior of the receptacle means as are the remainder of the components of the assembly.

Again with regard to FIGS. 2 and 3, each of the arms 50 and/or 50′ include a plurality of notches 52 on the upper longitudinal edge thereof. These notches are to secure the individual garments or clothing 10 on the arms and prevent inadvertent removal therefrom. While the embodiment of FIG. 1 shows the garments individually attached to the arms without the aid of conventional clothes hangers, such notches 52 are structured to supportingly engage such conventional clothes hangers and the garments or clothes may be supported thereon and in turn supported from the individual arms 50 or 50′ by conventinal clothes hangers.

Figure 6:
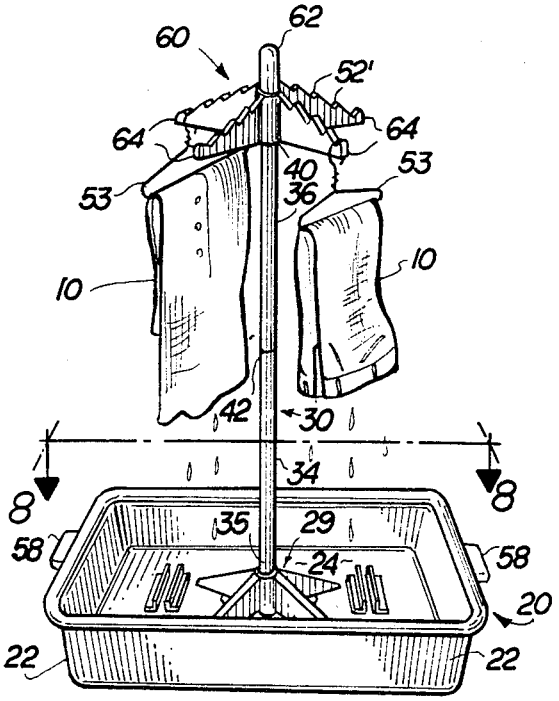
FIG. 6 is an isometric view of another embodiment of the drying assembly of the present invention with garments mounted thereon.

As shown in the preferred embodiment of FIG. 6, the receptacle means 20 includes upstanding stanchion 30 including stanchion portions 34 and 36 serving to support at an upper free end as at 40, mounting means 60. The mountng means in this embodiment includes a hub portion 62 and arm means comprising at least one and preferably a plurality of radially extending arms 64 directed outwardly from hub 62. In the embodiment of FIGS. 6 through 11, the hub portion 62 and the plurality of arms 64 comprising the arm means is formed into an integral, one-piece construction wherein each of the arms 64 includes notches 52′ formed along an upper edge thereof. Each of these notches is dimensioned and configured to receive a convetional clothes hanger 53 or the like for supporting the articles of clothing 10 on the individual arm 64.

Figure 7:
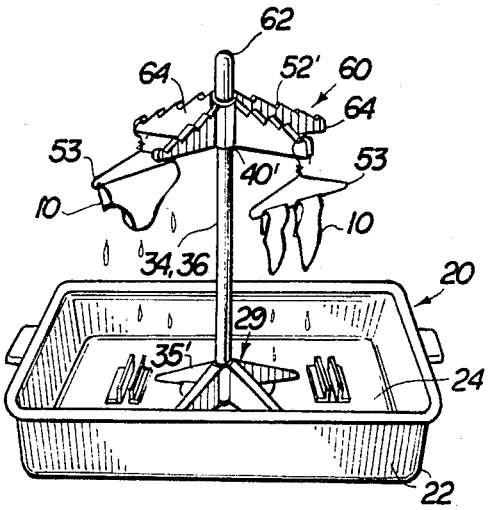
FIG. 7 is an isometric view of the embodiment of FIG. 6 with only one stanchion portion disposed in operative position.
Figure 8:
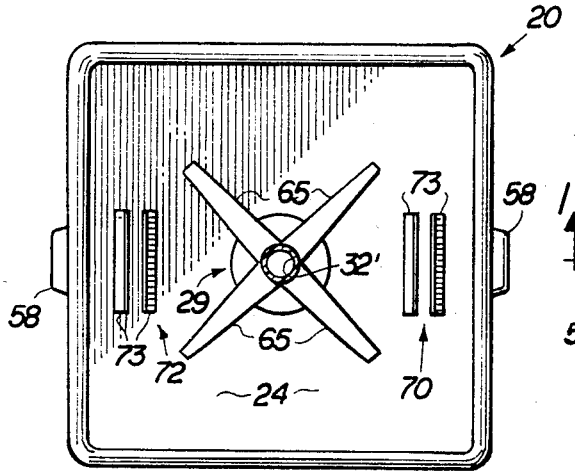
FIG. 8 is a sectional view along lne 8—8 of FIG. 6.
Figure 9:
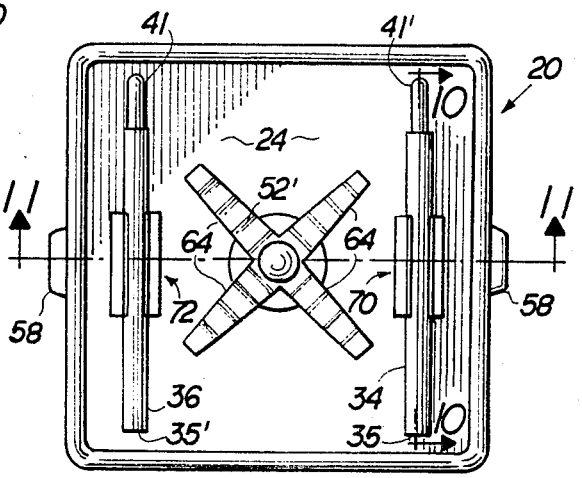
FIG. 9 is a top plan view of FIG. 11.
Figure 11:
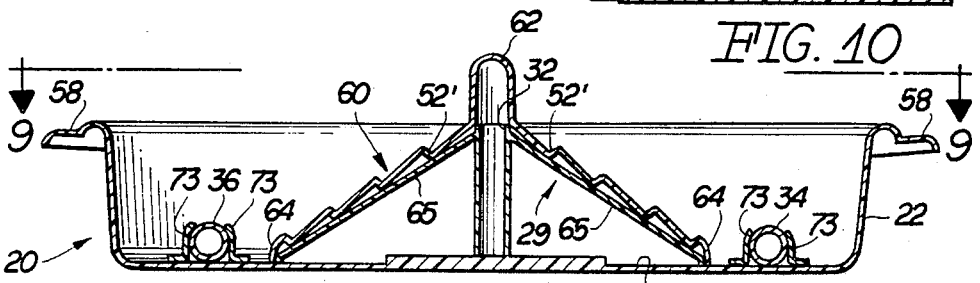
FIG. 11 is a sectional view along line 11—11 of FIG. 9.

It should be noted that each of the stanchion portions 34 and 36 include an end portion 41′ and 41 respectively which is dimensioned and configured to fit within either the opposite end 35′, 35 of the other stanchion portion or within the interior of the hub portion 62. As shown in FIG. 11, the mounting means 60 including the plurality of arms 64 and the hub portion 62 have a hollow interior portion which is accessible from the under portion of the mounting means 60. This allows the respective ends 41 or 41' to be fitted in telescopic relation within the interior of the hub portion 62 for mounting in an operative position as represented in FIGS. 6 and 7. It should be noted that the stanchion 30 may be represented by only a single stanchion portion 34, 36 (FIG. 7) when it is desired or necessary to position the mounting means 60 a shorter distance above but in overlying relation to the interior of the receptacle means 20.

In the embodiments of FIGS. 6 through 11, the connecting means 29 is formed to include a plurality of connecting arms 65 which extend upwardly from a floor or base 24 of the receptacle 20. Also, the connecting arms 65 are collectively dimensioned and configured in correspondence with the plurality of arms 64 such that the mounting portion 60 may be fitted in a nested fashion over the mounting means 29 (see FIG. 11). In such position, the mounting means 60 is nested in a retained, frictional engagement with the connecting means 29 so as to be retained in at least partially covering relation within the interior of the receptacle 20 for storage.

To better accomplish such stored position, the embodiment of FIGS. 6 through 11 further includes retaining means in the form of a first and second retaining portion 70 and 72. Each retaining portion comprises an upstanding spaced apart pair of flanges 73 which are inherently flexible or biased so as to provide a removable snap action type of fit about the respective stanchion portions 34 and 36. For purposes of clarity, the connecting means 29 when in the disposition represented in FIG. 11 may also be considered part of the retaining means in that it serves to frictionally engage and thereby retain the mounting means 60 as shown. In such position, the hub portion 62 is disposed in overlying relation to the central socket 32 which serves to engage the lower end 35 or 35' of the stanchion or stanchion portions as shown in FIGS. 6 and 7.

Figure 10:
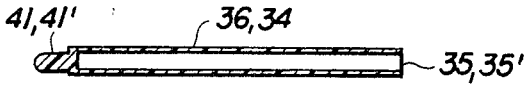
FIG. 10 is a sectional view along line 10—10 of FIG. 9.

With regard to FIG. 10, the details of each of the stanchion portions may be substantially identical both in configuration and dimension and so as to be interchangeable when forming the entire elongated stanchion 30. In addition, it should be noted that a plurality of stanchion portions more than two can be utilized to form the elongated stanchion 30 and still fall within the intended scope of the present invention.

It should be noted that while not specifically disclosed, the stanchion portion may be relatively dimensioned such that one fits inside the other in telescoping relation. In such an embodiment, the full height of the stanchion may be realized by outwardly extending the telescoped stanchion portions relative to one another and providing their interconnection in such outwardly extending position by a spring biased finger mounted on one stanchion portion passing through an aligned aperture mounted on the other stanchion portion. Such spring biased finger and "snap fit" connection is well known in the prior art.

In the embodiments shown, the receptacle 20 may be as deep as desired to accommodate the water collection. Preferably, handle means may be provided for the receptacle such as an outturned lips 58, (FIG. 11) or finger openings 21 and 21' (FIG. 1).

What is claimed is:

1. A clothing drying assembly of the type primarily designed to support clothes and like articles for drying, said assembly comprising:

(a) support means structured for support of clothing thereon and including a stanchion and a mounting means, (b) receptacle means for catching water from clothes drying on said support means and being removably connected in supporting relation to said stanchion and disposed in underlying relation to said mounting means, (c) said stanchion extending upwardly from said receptacle means and said mounting means removably connected to said stanchion at an opposite end thereof relative to said receptacle means and in overhanging relation to said interior of said receptacle means, (d) connecting means connected to said receptacle means and structured for support and engagement of one end of said stanchion in said upwardly extending relation to said receptacle means, (e) said mounting means comprising an arm means for attaching clothes on said support means and removably securable to said stanchion in spaced, overhanging relation to an interior of said receptacle means, (f) said arm means comprising a hollow interior portion being open and accessible from an under portion of said arm means, said arm means being dimensioned and configured for removable overlying engagement with said connecting means when detached from said stanchion, (g) said receptacle means further structured to retain said stanchion and said arm means in at least partially surrounding relation within said receptacle, when detached from one another, and (h) said connecting means is at least partially configured and dimensioned to correspond to said arm means and positionable in retaining, supporting engagement within said hollow interior portion, said arm means being removably retained within said receptacle interior when detached from said stanchion.

2. An assembly as in claim 1 wherein said arm means comprises a hub portion and a plurality of arms secured to said hub portion in spaced relation to one another and extending radially outward from said hub portion, said hub portion removably attachable to one end of said stanchion for disposition of said plurality of arms in spaced, overlying relation to said receptacle interior.

3. An assembly as in claim 2 wherein said plurality of arms comprise a hollow interior portion being open and accessible from an under portion of said arm means, said plurality of arms being dimensioned and configured for removable, overlying engagement with said connecting means.

4. An assembly as in claim 3 wherein said connecting means comprises a plurality of connecting arms extending outwardly from a surface of said receptacle means and including a collectively corresponding configuration and dimension relative to said plurality of arms of said arm means and being received within said hollow interior portion in retaining relation to said arm means when the latter is detached from said stanchion.

5. An assembly as in claim 4 wherein said connecting means includes a centrally disposed socket positioned contiguous said connecting arms and structured and dimensioned to coaxially receive one end of said stanchion therein, said stanchion removably retained in an upstanding relation relative to said receptacle means.

6. An assembly as in claim 1 wherein said stanchion comprises at least a first and a second portion removably attached in coaxial relation to one another, said first portion connected at a free end to said receptacle means, said second portion connected at a free end thereof in supporting relation to said mounting means.

7. An assembly as in claim 6 wherein correspondingly positioned ends of said first and said second stanchion portions are removably secured to one another and separable from one another and from said mounting means and said receptacle means respectively.

8. An assembly as in claim 6 further comprising retaining means for retaining portions of said assembly when not in use and being secured to said receptacle means and structured for removable engagement of said stanchion in retaining relation thereto within said receptacle interior.

9. An assembly as in claim 8 further comprising said retaining means including a first retaining portion and a second retaining portion, both said retaining portions secured to an interior surface of said receptacle means and dimensioned and disposed to retain respective ones of said first and said second stanchion portions on said receptacle interior when said assembly is not in use.

10. An assembly as in claim 9 further comprising said retaining means being partially defined by said connecting means; said arm means comprising a hollow interior portion being open and accessible from an under portion of said arm means, said arm means being dimensioned and configured for removable, overlying and nested engagement with said connecting means and removably maintained thereon for retention at least partially within said receptacle interior.

11. An assembly as in claim 2 wherein said hub portion is removably mounted on an opposite end of said stanchion relative to said connecting means, said hub portion being at least partially hollow on the interior thereof and being accessible from said under portion, said opposite end of said stanchion disposable within said hub portion in coaxial relation thereto.

12. An assembly as in claim 2 wherein said plurality of arms and said hub portion comprise an integral, one-piece construction structured for selective removable securement to said stanchion and said connecting means, an operative position of said arm means defined by securement of said arm means to said stanchion and a stored position of said arm means defined by securement of said arm means to said connecting means.

* * * * *